US007632997B2

(12) United States Patent
Small et al.

(10) Patent No.: US 7,632,997 B2
(45) Date of Patent: Dec. 15, 2009

(54) SPRING-BIASED TUNING MACHINE

(75) Inventors: Craig Small, Framingham, MA (US); Mark S. Izen, Chestnut Hill, MA (US)

(73) Assignee: First Act Inc., Boston, MA (US)

( * ) Notice: Subject to any disclaimer, the term of this patent is extended or adjusted under 35 U.S.C. 154(b) by 0 days.

(21) Appl. No.: 11/852,947

(22) Filed: Sep. 10, 2007

(65) Prior Publication Data

US 2009/0064841 A1 Mar. 12, 2009

(51) Int. Cl.
*G10D 3/14* (2006.01)

(52) U.S. Cl. ..... 84/306; 84/297 R

(58) Field of Classification Search ..... 84/306, 84/304, 305, 297 R; D17/20
See application file for complete search history.

(56) References Cited

U.S. PATENT DOCUMENTS 4,827,825 A * 5/1989 Goto et al. ..... 84/306
4,970,930 A * 11/1990 Secord ..... 84/306
5,018,424 A * 5/1991 Steinberger ..... 84/304
5,728,955 A * 3/1998 Sperzel ..... 84/306
6,078,001 A * 6/2000 Kang ..... 84/304
6,580,022 B2 * 6/2003 Kang ..... 84/304
6,608,248 B1 * 8/2003 Sperzel ..... 84/306
2007/0012158 A1 * 1/2007 Kang ..... 84/304

* cited by examiner

*Primary Examiner*—Jianchun Qin
(74) *Attorney, Agent, or Firm*—Townsend and Townsend and Crew LLP

(57) ABSTRACT

A tuning machine for a musical instrument includes a base configured to engage a headstock of the musical instrument, an actuator rotatably connected to the base, a shaft rotatably connected to the base, the shaft providing a first aperture sized to receive a string of the musical instrument, the shaft being connected to the actuator such that actuation of the actuator causes rotation of the shaft about an axis of the shaft, a clamp member movably connected to the shaft and configured to engage the string, and a bias member connected to the clamp member and the shaft to bias the clamp member toward a closed position to engage the string when received by the shaft, where the clamp member and the shaft cooperate to inhibit removal of the string received by the shaft with the clamp member engaging the string.

8 Claims, 6 Drawing Sheets

SPRING-BIASED TUNING MACHINE

BACKGROUND

Tuning machines are used to adjust the tension of strings of musical instruments, such as guitars, to affect the sound provided by the strings when plucked or strummed or otherwise played. For a guitar, the tuning machines are typically mounted to the headstock of the guitar. The strings extend from the body of the guitar, along the neck to the headstock. The strings extend over the frets on the neck of the guitar and over a nut at the junction between the neck and the headstock. The strings extend through respective tuning machines mounted to the headstock. Finger plates or knobs on the tuning machines can be rotated to cause shafts of the tuning machines, through which the strings respectively extend, to rotate to adjust the tensions on the strings.

New strings can be inserted into tuning machines as appropriate, e.g., when the guitar is first assembled or after a string breaks. To restring the guitar, the new string is affixed to the body of the guitar and run up the neck, over the nut, and into the respective tuning machine. The string is threaded through a hole in a shaft of the tuning machine, cut (as appropriate/desired), and wrapped around the neck of the tuning machine. The tuning machine is then rotated in the direction of the wrapping such that the string coils around the neck of the tuning machine until the desired tension is achieved. After the initial threading, the person restringing the guitar holds the guitar string wrapped about the neck of the tuning machine and begins rotating the tuning machine finger plate. The user typically holds the string in place until the string has been wrapped about the neck of the tuning machine such that the string can be let go without the string slipping back through the hole in the shaft of the tuning machine. Alternatively, the user can wrap the string, after threading it through the hole in the shaft, about the neck several times before beginning to rotate the finger plate of the tuning machine.

SUMMARY

In general, in an aspect, the disclosure provides a tuning machine for a musical instrument, the tuning machine including a base configured to engage a headstock of the musical instrument, an actuator rotatably connected to the base, a shaft rotatably connected to the base, the shaft providing a first aperture sized to receive a string of the musical instrument, the shaft being connected to the actuator such that actuation of the actuator causes rotation of the shaft about an axis of the shaft, a clamp member movably connected to the shaft and configured to engage the string, and a bias member connected to the clamp member and the shaft to bias the clamp member toward a closed position to engage the string when received by the shaft, where the clamp member and the shaft cooperate to inhibit removal of the string received by the shaft with the clamp member engaging the string.

Implementations of the tuning machines may include one or more of the following features. The clamp member is slidably connected to the shaft to slide parallel to the axis of the shaft. The clamp member provides a second aperture sized to receive the string and the clamp member is connected to the shaft to slide between the closed position and an open position, where in the closed position the first and second apertures are disposed relative to each other to inhibit receipt of the string by the first and second apertures concurrently and in the open position the first and second apertures are disposed relative to each other to receive the string by the first and second apertures concurrently. The first and second apertures are substantially circular through holes each with a diameter of about 2 mm. The clamp member and the shaft are configured such that the clamp member can slide a total of about 2 mm relative to the shaft. The shaft is hollow along its length and the clamp member is disposed at least partially inside the shaft.

In general, in another aspect, the disclosure provides a tuning machine for a musical instrument, the tuning machine including a base configured to engage a headstock of the musical instrument, an actuator rotatably connected to the base, a shaft rotatably connected to the base, the shaft providing a first aperture sized to receive a string of the musical instrument, the shaft being connected to the actuator such that actuation of the actuator causes rotation of the shaft about an axis of the shaft, a slider slidably connected to the shaft such that the slider can move substantially parallel to the axis relative to the shaft, the slider being substantially rotatably fixed relative to the shaft such that rotation of the shaft by the actuator causes substantially similar rotation of the slider, the slider providing a second aperture sized to receive the string of the musical instrument, the first and second holes having substantially parallel axes, the slider being slidable relative to the shaft between a first, open position where the first and second apertures are aligned sufficiently to receive the string in the shaft and the slider from outside the tuning machine and a second, closed position where the first and second apertures are misaligned sufficiently to prevent receipt of the string into both the shaft and the slider, and a spring disposed in the shaft and connected to the slider to bias the slider toward the closed position.

Implementations of the tuning machines may provide one or more of the following features. The shaft includes a hollow neck portion and the first aperture is a first hole provided through a wall of the neck portion. The slider includes a rod portion at least partially disposed within the hollow neck portion of the shaft. The second aperture is a second hole provided through the rod portion.

In general, in another aspect, the disclosure provides a tuning machine for a musical instrument, the tuning machine including a base configured to engage a headstock of the musical instrument, an actuator having a finger portion disposed outside the base and a first gear portion disposed inside the base, the actuator being rotatably connected to the base, a shaft having a second gear portion disposed inside the base meshing with the first gear portion and a neck portion disposed outside the base, the shaft being rotatably connected to the base, the shaft having a hollow neck portion providing a first hole through a wall of the neck portion, the first hole being sized to receive a string of the musical instrument therethrough, a plunger including a rod portion disposed at least partially inside the hollow neck portion of the shaft and providing a second hole through the rod portion, the second hole being sized to receive the string of the musical instrument therethrough, the first and second holes having substantially parallel axes, the rod portion being slidable within the neck portion of the shaft between a first, open position where the first and second holes align to provide a first opening sufficient to receive the string and a second, closed position where the first and second holes are misaligned to prevent receipt of the string into the plunger, and a spring disposed in the shaft and connected to the plunger to bias the plunger to the closed position.

Embodiments of the tuning machines may provide one or more of the following capabilities. Musical instruments can be strung and tuned using one hand. Safety can be improved for stringing a musical instrument.

DETAILED DESCRIPTION

Embodiments of the disclosure provide techniques for tuning musical instrument strings. For example, a tuning machine for a guitar includes a shaft with a through hole in its neck and a spring-biased plunger extending axially along the length of the shaft. The through hole extends transverse to the axis of the shaft. A through hole extending transverse to an axis of the plunger, and sized similarly to the hole through the shaft, is biased such that, in its normal on default position, the two holes overlap little, if at all. The plunger can be actuated to oppose the bias of the spring such that the hole through the shaft and the hole through the plunger are substantially aligned and overlapping to allow a guitar string to pass through the aligned holes. Release of the plunger allows the spring bias to push the plunger axially along the shaft such that the guitar string will be pinched and held in place by the walls of the holes through the plunger and the shaft. The tuning machine can have its shaft rotated by turning a finger plate of the tuning machine without holding the guitar string against the shaft or coiling the guitar string around the shaft prior to rotating the finger plate of the tuning machine. Other embodiments are within the scope of the disclosure, including the claims.

Figure 1:
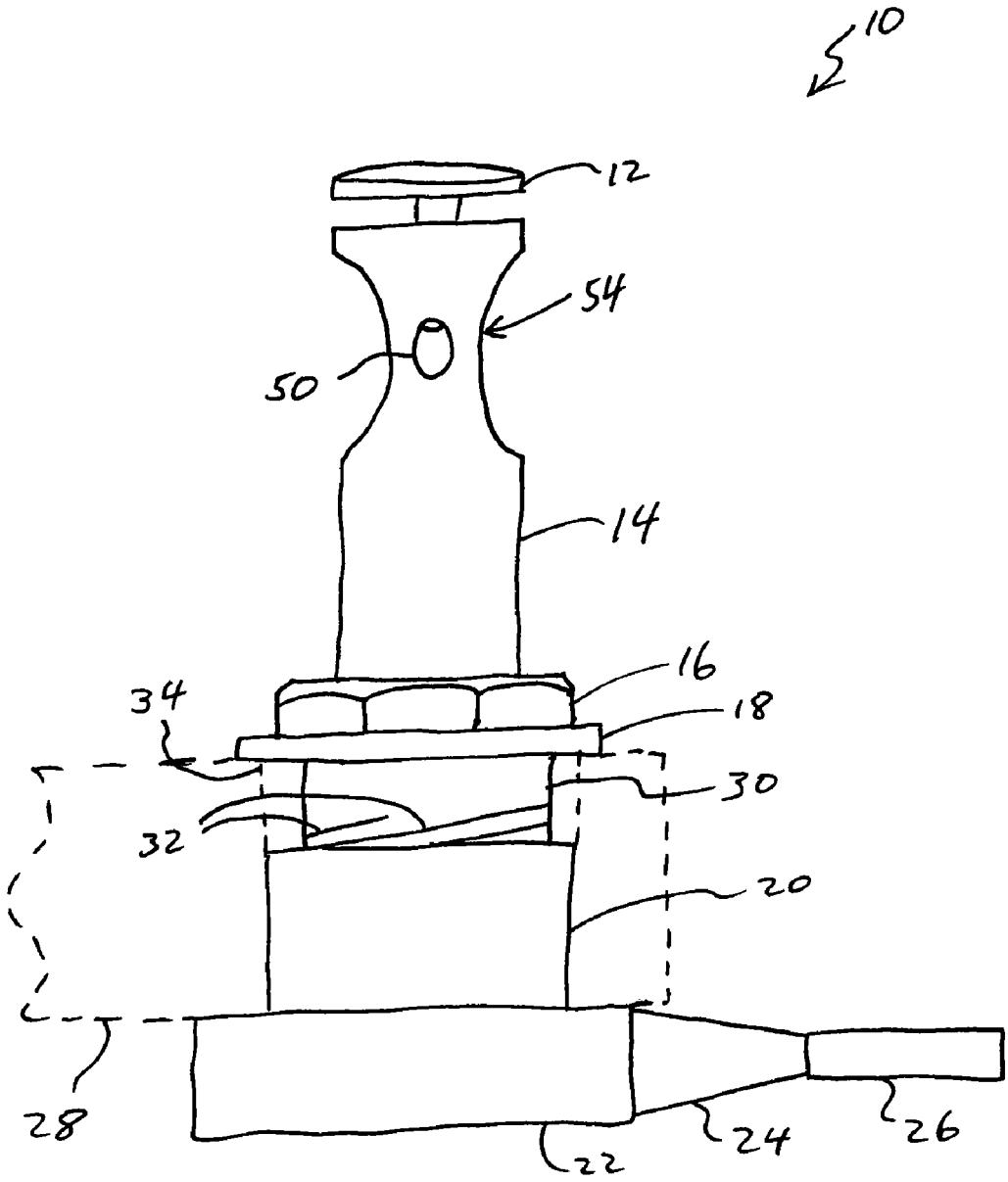
FIG. 1 is a side view of a tuning machine in a closed position.

Referring to FIG. 1, a tuning machine 10 includes a plunger 12, a rotating shaft 14, a nut 16, a washer 18, a guide 20, a base 22, an arm 24, and a finger plate 26. The tuning machine 10 is configured to fit through, cooperate with, and be attached to a headstock 28 of a guitar, or other musical instrument. The nut 16 includes a threaded tube portion 30, including threads 32, that threadably fits into the guide 20. The guide 20 is configured to fit snugly within a through hole 34 provided through the headstock 28. The nut 16 can be tightened into the guide 20 such that the washer 18 will be pressed against one side of the headstock 28 and the base 22 will be pressed against the other side of the headstock 28 to secure the tuning machine 10 in place with respect to the guitar. The tuning machine 10 is configured to assist with gripping a guitar string that is inserted through the shaft 14 for use in tuning the sound provided by the string.

Figure 2:
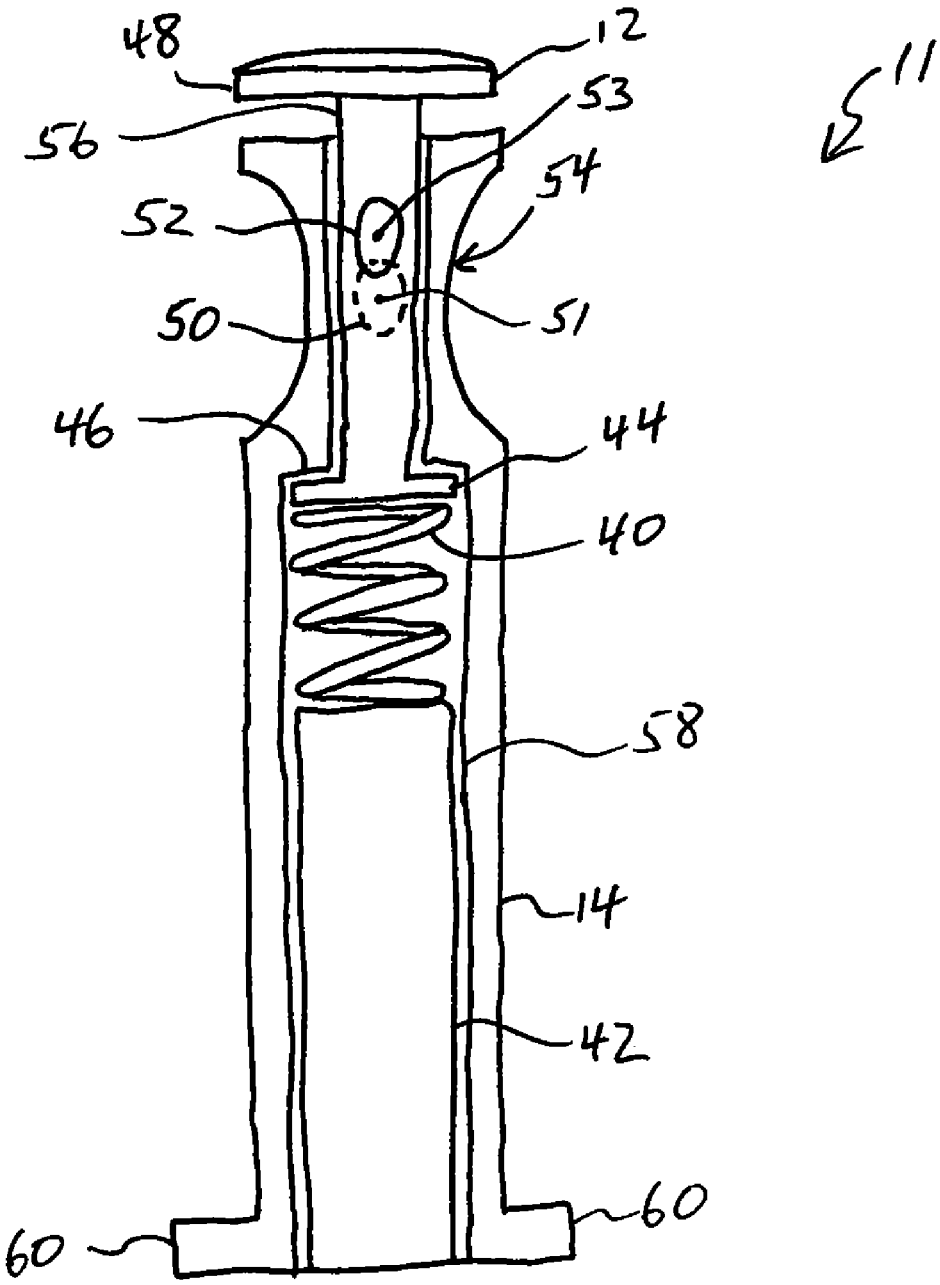
FIG. 2 is a partially cut-away view of a shaft assembly of the tuning machine shown in FIG. 1, in the closed position.
Figure 3:
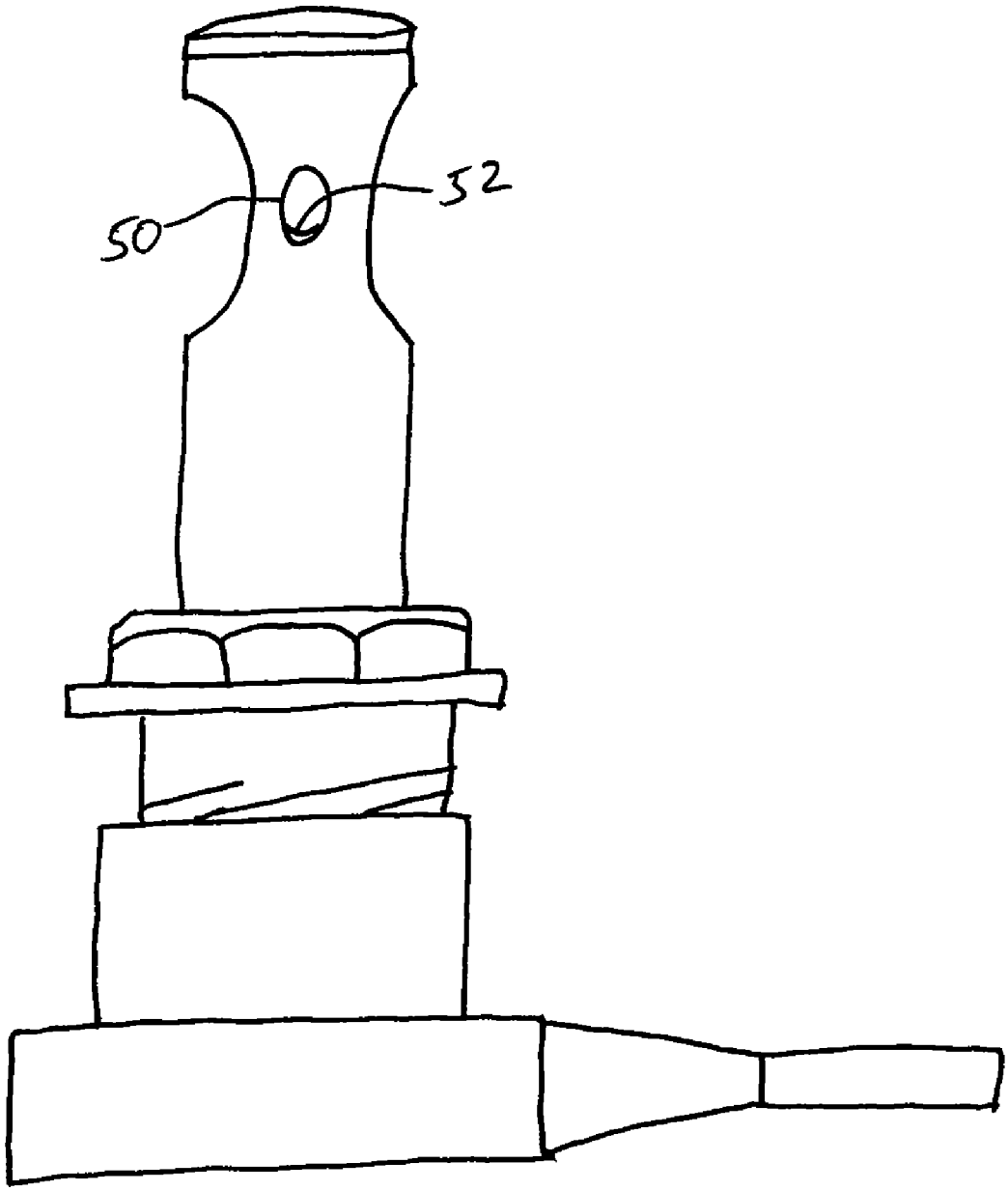
FIG. 3 is a side view of a tuning machine shown in FIG. 1, in an open position.
Figure 4:
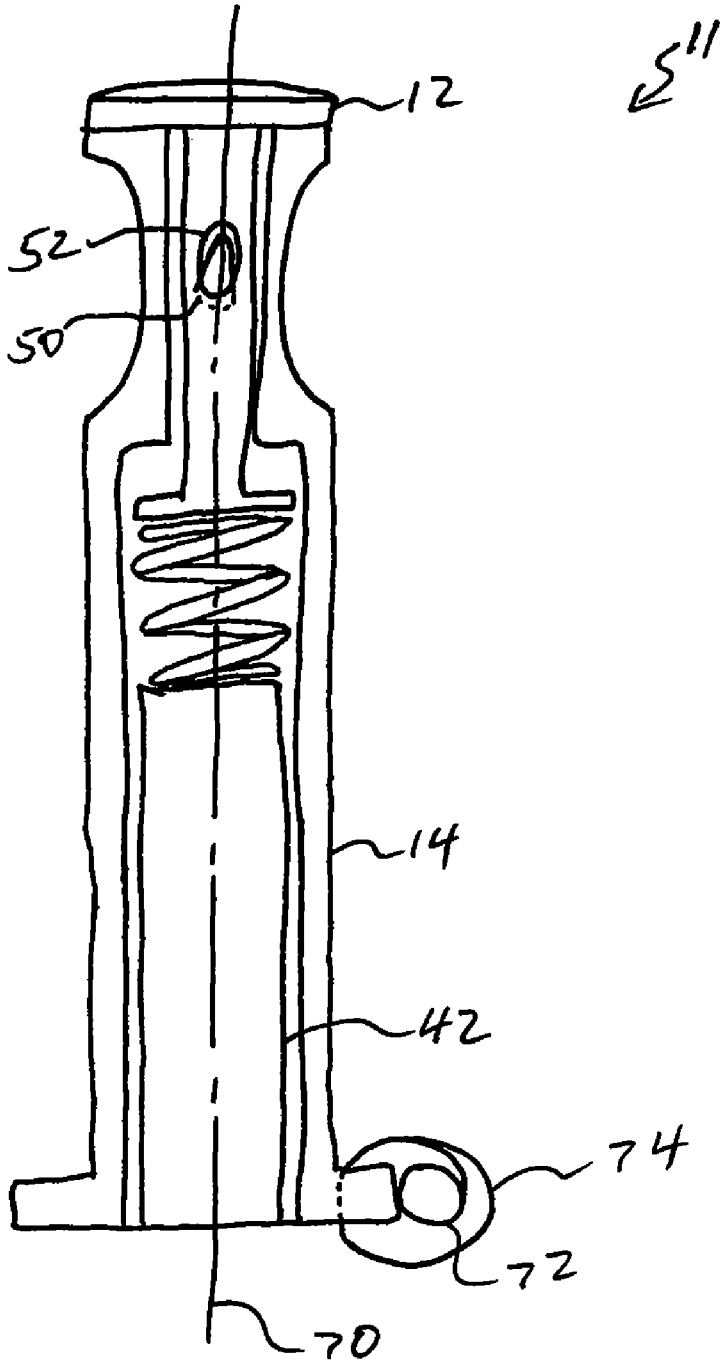
FIG. 4 is a partially cut-away view of the shaft assembly of the tuning machine shown in FIG. 3, in the open position, and a portion of a worm gear.

Referring also to FIGS. 2-4, the tuning machine 10, in particular a shaft assembly 11 portion shown in FIGS. 2 and 4, is configured to move between a resting, closed state/position shown in FIGS. 1-2 and an actuated, fully-open state/position shown in FIGS. 3-4. As shown in FIGS. 2, 4, the shaft assembly 11 includes a spring 40 and a support post 42. The support post 42 is fixedly attached to the shaft 14 such that the post 42 is fixed, not moving, relative to an axial length of the shaft 14 and rotates with the shaft 14. The plunger 12 and the shaft 14 are configured and connected such that the plunger 12 is slidable relative to the shaft 14 along an axis 70 of the plunger 12 and the shaft 14. The plunger 12 is connected to the shaft 14 such that rotation of the shaft 14 induces rotation of the plunger (e.g., one or more tabs can extend from a rod portion 56 of the plunger into one or more slots provided in an interior wall of the shaft 14). The compression spring 40 is configured to press against the post 42 and a flange portion 44 of the plunger 12 to bias the plunger 12 away from the post 42. The post 42 is sized and disposed within the shaft 14 relative to a ledge 46 provided by the shaft 14 such that the plunger 12 is biased against the ledge 46 in the absence of downward force on the plunger 12 toward the post 42. The spring 40 thus biases the plunger 12 into the fully-closed state in the absence of external forces, and can be moved into the fully-open state by applying pressure to a head 48 of the plunger 12. That is, the machine 10 can be opened by applying opposing, squeezing, forces on the plunger head 48 and the bottom of the post 42 such that the plunger 12, and, in particular the plunger flange 44, moves toward the post 42.

The shaft 14 and the plunger 12 each provide through holes for receiving a guitar string. The shaft 14 provides a through hole 50 and the plunger 12 provides a through hole 52. The hole 50 is provided in a neck portion 54 of the shaft 14 and the hole 52 is provided in the rod portion 56 of the plunger 12. The plunger 12 and the shaft 14 are aligned relative to each other and holes 50, 52 are sized and disposed in conjunction with each other such that, in the fully-closed position shown in FIGS. 1-2, the holes 50, 52 overlap slightly such that the overlap provides a line-of-sight opening though the shaft 14 and the rod 56 that is less than a diameter of any string to be inserted through the tuning machine 10. Alternatively, the holes 50, 52 may be sized and disposed not to overlap at all with the machine 10 in the fully closed position. The holes 50, 52 are further sized and disposed such that, when the tuning machine 10 is in the fully-open position shown in FIGS. 3-4, the holes 50, 52 overlap to provide a line-of-sight opening through the tuning machine to accommodate guitar strings (or other object) to be used in conjunction with the tuning machine 10. For example, the holes 50, 52 may both be substantially circular through holes with diameters of about two millimeters each and parallel axes 51, 53. Further, an amount of travel of the plunger 12, i.e., a distance between a top of the shaft 14 and a bottom of the plunger head 48 when the tuning machine 10 is in the fully-closed position, here about two millimeters, is preferably about the same as the diameter of the holes 50, 52. The hole 50 is disposed substantially in the middle of the axial length of the neck 54, which is a concave contoured portion of the shaft 14 for accommodating the guitar string when wrapped around the tuning machine shaft 14.

The holes 50, 52 and the spring 40 are configured such that, with a string inserted through the holes 50, 52, and opening force released from the plunger 12, the spring 40 will bias the plunger rod 56 against the inserted string, and the rod 56 and the shaft 14 will cooperate to provide sufficient friction to hold the guitar string in place while the shaft 14 is rotated. For example, while the through holes 50, 52 may be smooth-walled, one or both of the holes 50, 52 may have rough (e.g., serrated, jagged, rough-coated, etc.) surfaces to provide extra friction versus a smooth-walled hole.

The tuning machine 10 is configured to rotate the shaft 14 and the plunger 12 in response to rotation of the finger plate 26. As shown in FIG. 4, a worm gear 72 (shown in end view), that is connected to the finger plate 26, includes a spiral tooth 74 that meshes with the teeth 60 of the shaft 14. Rotation of the gear 72 causes the tooth 74 to push against one or more of the teeth 60 to turn the shaft 14 and thus the plunger 12.

The tuning machine 10 can be assembled relatively easily. The base 22, the arm 24, and the guide 20 can be cast out of appropriate metal. The finger plate 26 can be attached to the worm gear 72 disposed inside of the base 22 (e.g., by screwing). The plunger rod 56 and the flange 44 can be machined or cast or otherwise made and inserted through a counter-bored hole 58 through the shaft 14 that also provides the ledge 46 such that the holes 50, 52 are angularly aligned (i.e., their axes 51, 53 are parallel). The plunger head 48 can be attached to the rod 56, e.g., by welding. The spring 40 can be inserted into the hole 58, and the post 42 can be inserted into the hole 58 behind the spring 40 and affixed to the walls of the shaft 14. The shaft assembly 11 can be inserted through a hole in the base 22 and the guide 20 such that the teeth 60 in a gear portion of the shaft 14 mesh with the worm gear 72 attached to the finger plate 26. The hole through which the shaft assembly 11 is inserted can be sealed. The guide 20 can be inserted through the hole 34 provided in the headstock 28, and the washer 18 and the nut 16 slid over the top of the shaft assembly 11 such that the threaded tube 30 is fit into the guide 20. The washer 18 can be turned to tighten the washer 18 against the top of the headstock 28 to fix the tuning machine 10 in place relative to the headstock 28.

Figure 5:
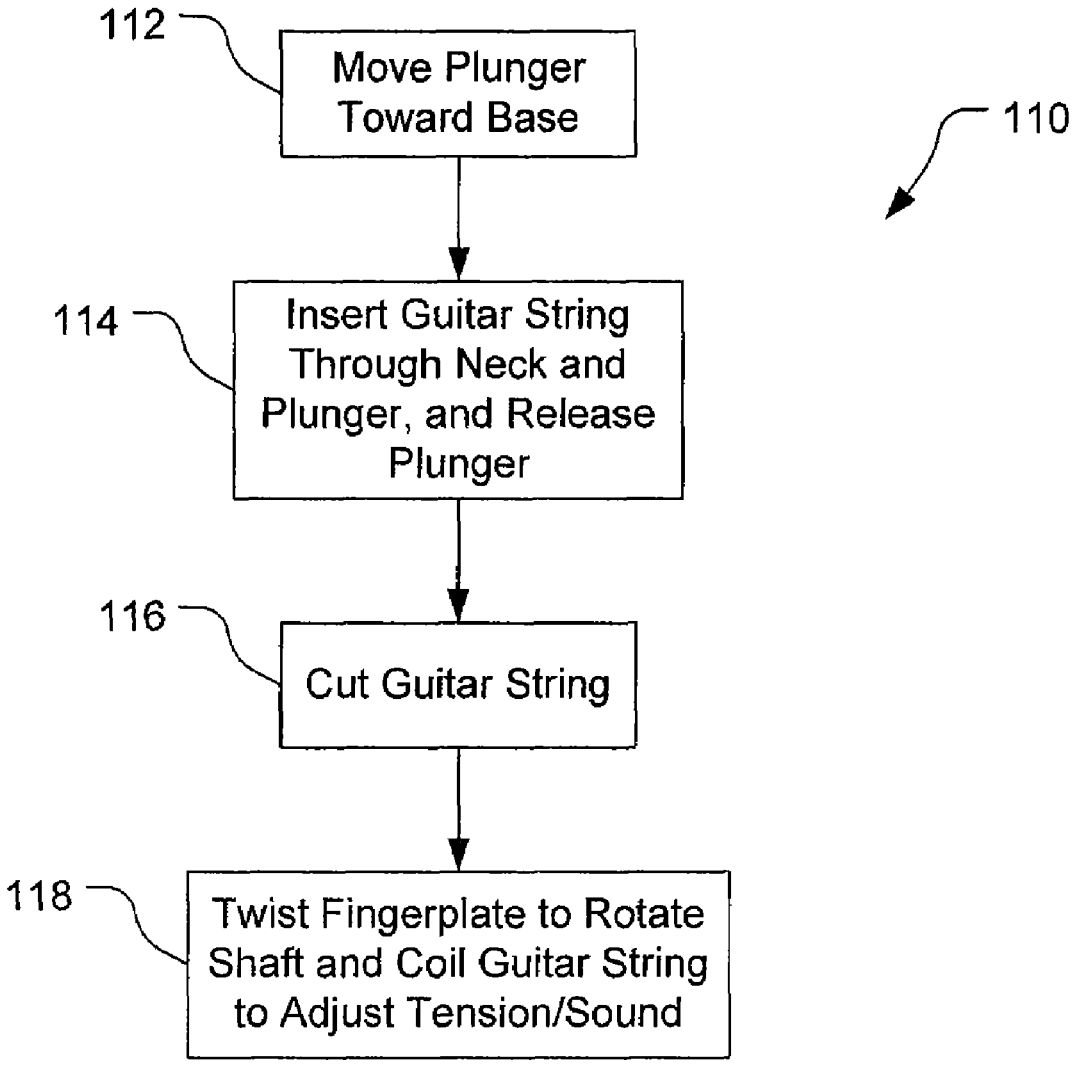
FIG. 5 is a block flow diagram of a process of using the tuning machine shown in FIG. 1 to string and tune a guitar string.

In operation, referring to FIG. 5, with further reference to FIGS. 1-4 and 6, a process 110 of adjusting the tension of a guitar string includes the stages shown. The process 110 is exemplary only and not limiting. The process 110 can be altered, e.g., by having stages added, removed, or rearranged.

At stage 112, a user pushes the plunger 12 relative to the base 22. The tuning machine 10 is in its normally-closed resting position and the user squeezes the plunger 12 and the base 22 such that the plunger 12 moves relative to the base 22. The plunger 12 moves toward the base 22, compressing the spring 40. The holes 50, 52 move from their slightly-overlapping closed state to a greater-overlapping relative position.

Figure 6:
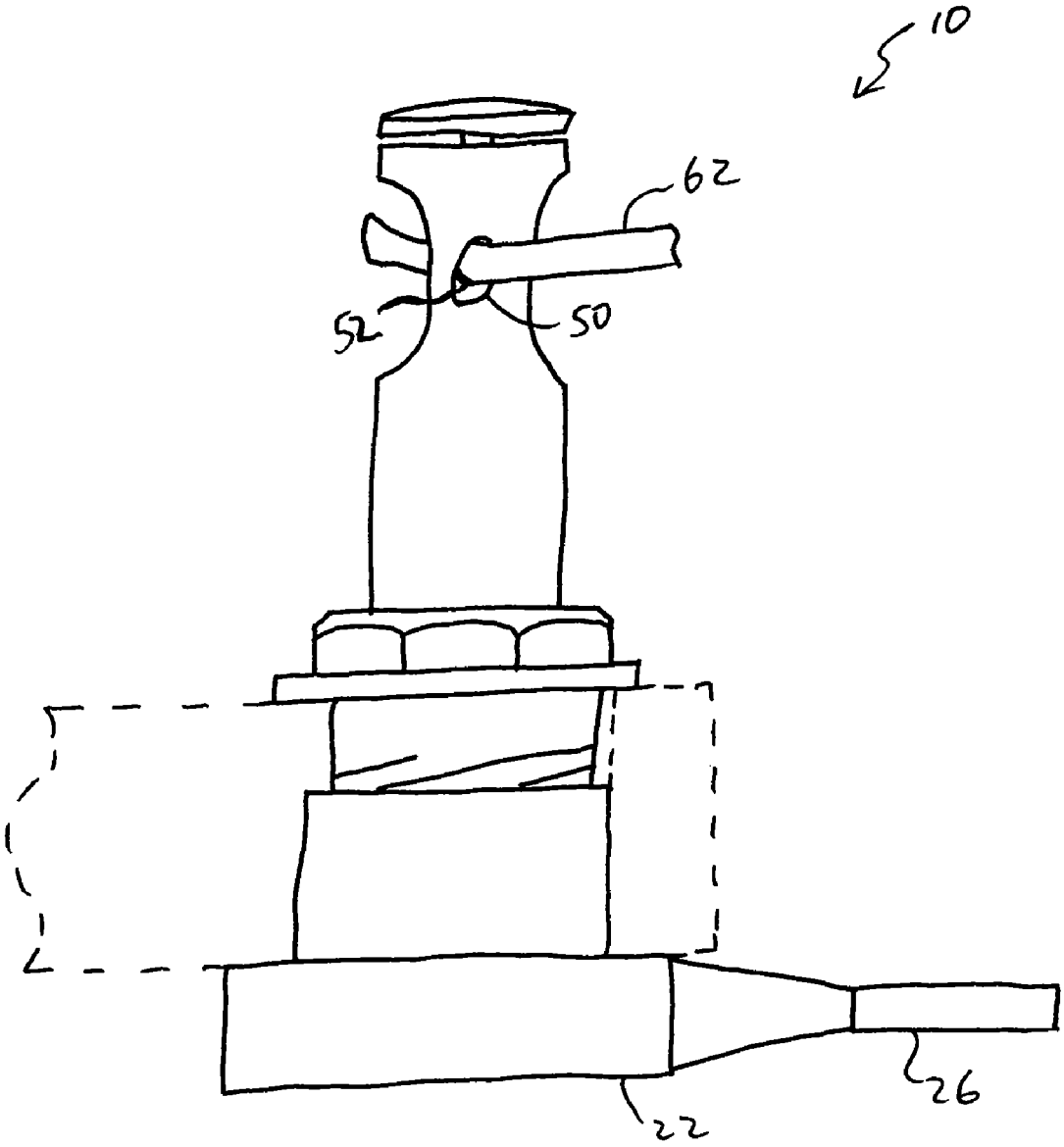
FIG. 6 is a side view of the tuning machine shown in FIG. 1 in use with a guitar string.

At stage 114, the user inserts a guitar string 62 through the holes 50, 52. At stage 112, the user has moved the plunger 12 enough such that the holes 50, 52 overlap to provide sufficient room for the desired guitar string 62 to be inserted through the holes 50, 52. The user preferably inserts the guitar string 62 completely through the holes 50, 52 such that the string 62 protrudes from the opposite side of the shaft 14 into which the string 62 was inserted. The user releases the plunger 12 once the string 62 extends through the holes 50, 52. The plunger 12 moves away from the base 22 until the guitar string 62 impedes further movement of the plunger 12. The plunger 12 is then in a relative position with respect to the shaft 14 that is an intermediate, partially-closed position between fully-open and fully-closed. This string-engaging position, as shown in FIG. 6, will vary depending upon the dimensions of the particular string 62 inserted through the tuning machine 10. The user preferably pushes or pulls the guitar string 62 through the overlapping holes 50, 52 until the guitar string 62 can be inserted no more through the holes 50, 52.

At stage 116, the tension on the guitar string 62 can be adjusted to tune the guitar string 62 to the desired pitch. The user twists the finger plate 26 relative to the base 22 to cause the worm gear 72 to push against the teeth 60 to cause the shaft 14 to rotate to increase tension on the guitar string 62. The user can twist the finger plate 26 and cause the shaft 14 to rotate to coil the string 62 about the neck 54 without having to hold the string 62 or wrap the string 62 around the neck 54 before beginning to twist the finger plate 26.

Other embodiments are within the scope of the disclosure. For example, while the hole 50 has been shown and described as a through hole through the shaft 14, non-through holes may be used. For example, a hole may be provided in one side of the tube portion comprising the neck 54 of the shaft 14 such that a guitar string may be inserted into the neck 54 but will not pass all the way through the neck 54. This may, for example, improve safety by limiting exposure of a potentially sharp end of a guitar string. Further, the plunger may be equipped to cut guitar strings in addition to hold guitar strings. For example, the plunger rod may include a sharp cutting portion configured to cut through a guitar string and a secondary portion configured to provide friction to hold the guitar string in place relative to the shaft 14. Or the plunger rod may comprise a knife edge that will cut the string if sufficient force, greater than that provided by the spring, is applied to the plunger and will help hold the string with only the spring force applied. Further still, multiple openings may be provided in the plunger rod with one opening providing a cutting mechanism for cutting a guitar string and another opening through the plunger rod providing frictional engagement for holding the guitar string in place. Further, while the discussion focused on guitars and guitar strings, disclosed embodiments can be applied to other uses, e.g., other musical instruments. Further still, the sliding member (the plunger, as described) could be on the outside of the shaft, the neck could be on the sliding member, and/or mechanisms other than a neck could be used to help retain a coiled string (e.g., pegs above and below holes for the string through the tuning machine). Alternatively, there may be no mechanism to retain the string around the tuning machine.

Still other embodiments are within the scope of the disclosure.

What is claimed is:

1. A tuning machine for a musical instrument, the tuning machine comprising:

a base configured to engage a headstock of the musical instrument;

an actuator rotatably connected to the base;

a shaft rotatably connected to the base, the shaft providing a first aperture sized to receive a string of the musical instrument, the shaft being connected to the actuator such that actuation of the actuator causes rotation of the shaft about an axis of the shaft;

a clamp member slidably connected to the shaft and configured to engage the string, wherein the clamp member is slidably connected to the shaft to slide parallel to the axis of the shaft, wherein the clamp member provides a second aperture sized to receive the string and wherein the clamp member is connected to the shaft to slide between the closed position and an open position, wherein in the closed position the first and second apertures are disposed relative to each other to inhibit receipt of the string by the first and second apertures concurrently and in the open position the first and second apertures are disposed relative to each other to receive the string by the first and second apertures concurrently; and a bias member connected to the clamp member and the shaft to bias the clamp member toward a closed position to engage the string when received by the shaft;

wherein the clamp member and the shaft cooperate to inhibit removal of the string received by the shaft with the clamp member engaging the string.

2. The tuning machine of claim 1 wherein the first and second apertures are substantially circular through holes each with a diameter of about 2 mm.

3. The tuning machine of claim 1 wherein the clamp member and the shaft are configured such that the clamp member is configured to slide a total of about 2 mm relative to the shaft.

4. A tuning machine for a musical instrument, the tuning machine comprising:

a base configured to engage a headstock of the musical instrument;

an actuator rotatably connected to the base;

a shaft rotatably connected to the base, the shaft providing a first aperture sized to receive a string of the musical instrument, the shaft being connected to the actuator such that actuation of the actuator causes rotation of the shaft about an axis of the shaft;

a slider slidably connected to the shaft such that the slider is configured to move substantially parallel to the axis relative to the shaft, the slider being substantially rotatably fixed relative to the shaft such that rotation of the shaft by the actuator causes substantially similar rotation of the slider, the slider providing a second aperture sized to receive the string of the musical instrument, the first and second holes having substantially parallel axes, the slider being slidable relative to the shaft between a first, open position where the first and second apertures are aligned sufficiently to receive the string in the shaft and the slider from outside the tuning machine and a second, closed position where the first and second apertures are misaligned sufficiently to prevent receipt of the string into both the shaft and the slider; and a spring disposed in the shaft and connected to the slider to bias the slider toward the closed position.

5. The tuning machine of claim 4 wherein the shaft includes a hollow neck portion and wherein the first aperture is a first hole provided through a wall of the neck portion.

6. The tuning machine of claim 5 wherein the slider includes a rod portion at least partially disposed within the hollow neck portion of the shaft.

7. The tuning machine of claim 6 wherein the second aperture is a second hole provided through the rod portion.

8. A tuning machine for a musical instrument, the tuning machine comprising:

a base configured to engage a headstock of the musical instrument;

an actuator having a finger portion disposed outside the base and a first gear portion disposed inside the base, the actuator being rotatably connected to the base;

a shaft having a second gear portion disposed inside the base meshing with the first gear portion and a neck portion disposed outside the base, the shaft being rotatably connected to the base, the shaft having a hollow neck portion providing a first hole through a wall of the neck portion, the first hole being sized to receive a string of the musical instrument therethrough;

a plunger including a rod portion disposed at least partially inside the hollow neck portion of the shaft and providing a second hole through the rod portion, the second hole being sized to receive the string of the musical instrument therethrough, the first and second holes having substantially parallel axes, the rod portion being slidable within the neck portion of the shaft between a first, open position where the first and second holes align to provide a first opening sufficient to receive the string and a second, closed position where the first and second holes are misaligned to prevent receipt of the string into the plunger; and a spring disposed in the shaft and connected to the plunger to bias the plunger to the closed position.

* * * * *